United States Patent [19]

Andre

[11] 4,061,942

[45] Dec. 6, 1977

[54] IN LINE GUN SUPPORT ARRANGEMENT WITH EXPANSION COMPENSATION

[75] Inventor: Wolfram Andre, Aichwald, Germany

[73] Assignee: International Standard Electric Corporation, New York, N.Y.

[21] Appl. No.: 748,786

[22] Filed: Dec. 9, 1976

[30] Foreign Application Priority Data

Dec. 17, 1975 Germany ..... 2556862

[51] Int. Cl.[2] ..... H01J 29/02; H01J 29/50

[52] U.S. Cl. ..... 313/417; 313/457

[58] Field of Search ..... 313/417, 411, 414, 457, 313/409, 413

[56] References Cited

U.S. PATENT DOCUMENTS

| | | | |
|---|---|---|---|
| 2,859,378 | 11/1958 | Gundert et al. | 313/414 X |
| 3,239,708 | 3/1966 | Johnson | 313/457 |
| 3,771,002 | 11/1973 | Standaart | 313/411 |
| 3,974,416 | 8/1976 | Goot et al. | 313/417 |

*Primary Examiner*—Robert Segal

*Attorney, Agent, or Firm*—John T. O'Halloran; Thomas M. Marshall

[57] ABSTRACT

Suspension elements for the electrodes in a multibeam electron gun, especially for a color television picture tube, having a novel construction are provided which cause their associated electrodes to either rotate about their axes or to remain in position to compensate for convergence drift during the warm up phase of the tube's operation.

1 Claim, 2 Drawing Figures

IN LINE GUN SUPPORT ARRANGEMENT WITH EXPANSION COMPENSATION

BACKGROUND OF THE INVENTION

1. Field of the Invention

Multibeam electron guns, and, particularly, color television picture tube construction.

2. Prior Art

Multibeam electron guns especially those utilized in color television picture tubes having individual electrodes associated with the individual beam bundles having an aperture which permits the passage of the beams therethrough. The electrodes are mounted to supporting rods with the aid of suspension elements.

One such electron gun is disclosed in German Published Patent Application No. 25,11,758.

Experience has shown that there occurs a phenomenon which is called "convergence drifting" in a color television picture from a tube employing such an electron gun for example, during the transitional period starting at the time when the tube is put into operation until it reaches its working temperature.

Convergence drifting, as is well known, is due to the thermal expansion of the suspension elements in the electron gun which causes a change in the position of the beam passage opening, for example, that associated with the modulator electrodes. This thermal expansion of the suspension elements has a particular effect upon the electrodes lying outside the tube's axis. Because those electrodes, owing to their spatial conditions in the tube's neck, are mounted to the supporting rods which consist of an insulating material, for example, glass, in such a way that the thermal expansion of the susupension elements cannot be compensated for those electrodes which lie outside the tube's axis, whereas the electrode lying in the tube's axis is not a problem.

In the arrangements in accordance with the aforementioned German Published Patent Application No. 25,11,758, convergence drifting is attempted to be avoided or to be kept very small by selecting a material having a thermal coefficient of expansion which is as small as possible so that no visual faults or errors appear on the viewing screen.

SUMMARY OF THE INVENTION

It is the object of the structure of this invention to provide a way of preventing thermal expansion caused "convergence drifting" utilizing structural techniques which have the least possible visual influence upon the convergence.

According to this invention the solution to the problem identified above resides in mounting at least the suspension elements for the electrodes directly adjacent to the cathode in such a way and having such a shape so that longitudinal variations in the positon of the suspension elements caused by the heating up of the electron gun are either compensated for in a manner known and/or will cause a rotation of the electrode associated with the suspension element vertically around the electron beam axis.

The solution offered by this invention has the advantage that the selection of the material utilized for the suspension elements can be determined by the necessary magnetic and processing technical properties and is not primarily determined alone by the characteristic thermal coefficient of expansion of the material utilized.

In accordance with one practical example of an embodiment of this invention each of the two modulator electrodes for the outer beams are connected to one glass rod through two suspension elements so that the force caused by the longitudinal expansion of the suspension elements will be transmitted to the modulator electrodes tangentially and in the same direction of rotation about the axis of the beam.

BRIEF DESCRIPTION OF THE DRAWINGS

The device of this invention will be better understood by reference to the accompanying drawings, in which.

DESCRIPTION OF THE PREFERRED EMBODIMENT

Figure 1:
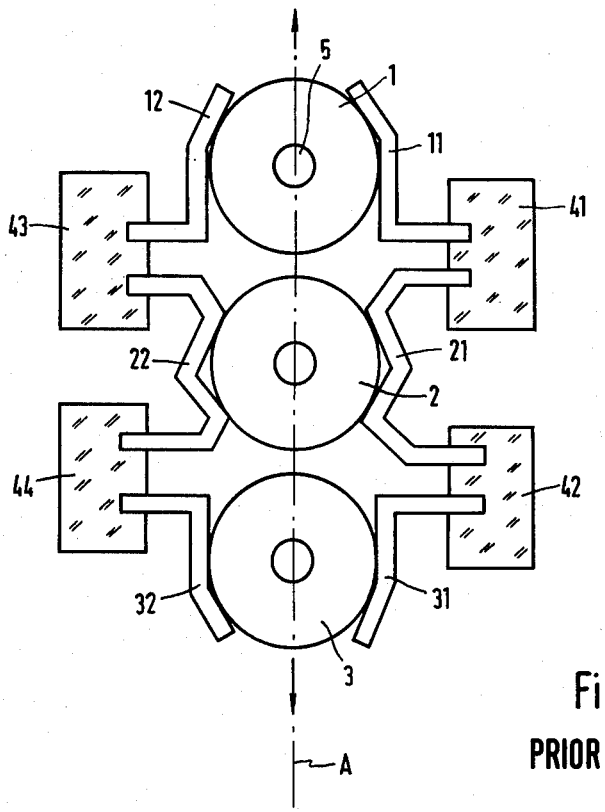
Fig.1 PRIOR ART
FIG. 1 shows a cross-sectional representation of an electron gun in the plane of the modulator electrodes illustrating the construction of suspension elements in accordance with the prior art.

As is illustrated in FIG. 1, in the prior art device the axes 5 of the three electron beams are all in one line. FIG. 1 is a cross sectional view taken through an electron gun of the prior art in the plane of the modulator electrodes 1, 2 and 3. The modulator electrodes 1, 2 and 3 and their suspension on supporting rods 41 through 44, each of which is made from an electrically insulating modulator such as glass, are of particular importance to the convergence drifting problem because the thermal expansion is particularly effective because these elements are directly adjacent cathodes which are operated at a relatively high temperature.

The center electrode 2 is mounted completely symmetrically to all support rods 41 through 44 by means of, for example, W-shaped suspension elements 21 and 22. Due to the symmetry of the suspension elements 21, 22 and the associated support rods 41 through 44, thermal expansions apparently do not have any appreciable affect upon the position of the beam aperture in electode 2 and thus the position of the axis 5 of the electron beam remains unchanged.

However, that situation is quite different in the case of the suspension of the two outer electrodes 1, 3.

As will be seen in FIG. 1, there is only partial symmetry as regards to suspension elements 11, 12 or 31, 32 respectively. It will be seen that suspension elements 11, 12 and 31, 32 are each only affixed to one of the support rods 41 through 44. The partial symmetry of the suspension is due to the fact that the suspension elements 11, 12, 31, 32 by means of a portion atttached to their respective supporting rods extends along an axis vertically in relation to the system line A. Longitudinal variations of the two angled off parts of the suspension elements 11, 12 and 31, 32 each lie in this axis and are compensated for with respect to the positioning of the associated electrodes 1, 3. Longitudinal variations of the parts of the suspension elements 11, 12 and 31, 32 arranged in parallel with the system line A effect a displacement of the electrodes 1, 3 along the system line A in opposite directions as indicated by the arrows at the top and bottom of FIG. 1.

Due to the restricted space within the tube's neck (not shown), as has been previously mentioned, it is impossible to achieve a completely symmetrical suspension of all of the electrodes which is, however, possible with respect to electrode 2 as described above.

Figure 2:
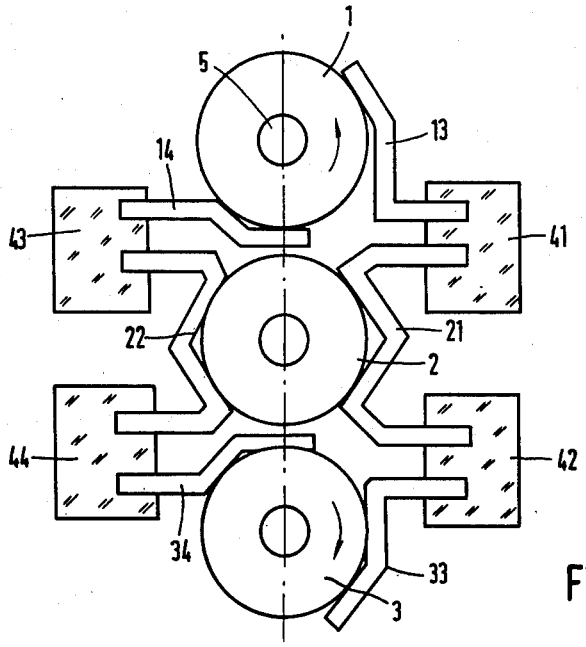
FIG. 2 is a view of a portion of an electron gun similar to FIG. 1 but showing an illustrative embodiment of a construction in accordance with the teachings of this invention.

FIG. 2 shows an electron gun arrangement in accordance with the present invention and is, as is the case of FIG. 1, a cross sectional view taken through the plane of the modulator electrodes. The suspension of the central electrode 2 remains the same as illustrated in FIG. 1 for the reasons described in detail in connection with the description of FIG. 1. Accordingly, the reference numerals in FIG. 2 are the same, as are those reference characters which indicate support rods 41 through 44.

However, it will be noted that the arrangement in accordance with FIG. 1 has been modified in the construction illustrated in FIG. 2 since suspension elements 13, 14 and 33, 34 no longer engage electrodes 1, 3 in parallel and in the same direction with respect to the system line A. Instead, the suspension elements 13, 14 and 33, 34 engage electrodes 1, 3 in such a way that the expansion of the suspension elements 13, 14 and 33, 34 substantially effect a turning or rotation of electrodes 1 and 3 around the associated axis 5 of the electron beam as indicated by the circular arrows in electrodes 1 and 3 illustrated in FIGS. 1 and 2.

With regard to the construction illustrated in FIG. 2 there might be an objection that there is remaining in that construction a slight displacement left over due to that construction. However, that remainder can be made arbitrarily small, for example, so small that the effect thereof will not produce any visible consequences on the viewing screen due to existing manufacturing tolerances.

While the invention has been described in conjunction with the construction of a so called "in line" system, it will be appreciated by those of skill in the art that, in other systems, for example, "delta" systems, it is possible to construct the suspension elements and position them with respect to the electrodes so that longitudinal expansions of the suspension elements are converted into rotation of the involved electrode which would thus avoid the lateral displacement of that associated electrode and hence avoid convergence drifting.

From the description above, it will be appreciated that the device of this invention describes a multibeam electron gun, especially for a color television picture tube, in which for the individual beam bundles there are provided individual electrodes each of which has an aperture for permiting the passage of the beams therethrough in which the electrodes are mounted to supportng rods utilizing suspension elements which is characterized in that the suspension elements 13, 14, 21, 22, 33, 34 for the electrodes 1, 2, 3 directly adjacent the cathode are shaped in such a way, and connected to the electrodes 1, 2, 3 so that the longitudinal variations of the suspension elements 13, 14, 21, 22, 33, 34 caused by the heating up of the electron gun are either compensated for in a manner known per se and/or effect a rotation of the associated electrode substantially vertically around the electron beam axis 5.

It will also be appreciated that there is provided an electron gun, in accordance with the teachings of this invention, which generates three electron beams in one line; in which the center focused beam extends in the longitudinal axis of such a gun for a color television picture tube; there are four glass rods arranged around the longitudinal axis of the color television picture tube positioning the modulator and other electrodes, with the modulator electrode for the center electron beam being held in position by a substantially W-shaped suspension elements 21, 22, each of which is attached to two glass support rods 41, 42, 43, 44; and wherein the two modulator electrodes for the outer beams, through suspension elements 33, 34, are connected to one of the support rods 41, 42, 43, 44 and are shaped so that the force caused by the longitudinal expansion of the elements substantially engage their associated modulator electrode tangentially and in the same sense of rotation around the axis of the beam.

Having described this invention in connection with specific constructions, it will be appreciated by men of skill in the art that modifications can be made which do not depart from the scope of the appended claims.

What is claimed is:

1. An electron gun for a multibeam electron tube which generates three electron beams in one line, the center focused beam thereof extending in the longitudinal axis of said tube, comprising:

four glass rods arranged around said longitudinal axis of said tube;

three modulator electrodes;

suspension elements connected to said four glass rods on one end portion thereof and contacting said electrodes on the other end, said center electrode for said center electron beam being held in position by two of said suspension elements each of which is affixed to two of said glass rods, said four glass rods being arranged in pairs on opposite sides of said modulator electrodes;

means for connecting two suspension elements for each of said modulator electrodes for the outer beams each pair of suspension elements for each outer beam electrode having ends connected to glass rods on opposite sides of each said electrode, and opposite ends contacting opposite sides of each said electrode substantially tangentially whereby the forces caused by the longitudinal expansion caused by heating up of said electron gun substantially engage said outer modulator electrodes tangentially, and in the same sense of rotation, to cause rotation of said outer electrodes around said axis of each associated beam.

* * * * *